United States Patent [19]

Miller et al.

[11] 4,018,489

[45] Apr. 19, 1977

[54] METHOD FOR EXTENDING CATHODE LIFE IN VIDICON TUBES

[75] Inventors: Louis Donald Miller, Leola; Hans Popp, Strasburg, both of Pa.

[73] Assignee: RCA Corporation, New York, N.Y.

[22] Filed: Aug. 28, 1975

[21] Appl. No.: 608,562

[52] U.S. Cl. ..... 316/5; 316/12; 316/25

[51] Int. Cl.[2] ..... H01J 9/22

[58] Field of Search ..... 316/5, 12, 18, 25

[56] References Cited

UNITED STATES PATENTS

| | | | |
|---|---|---|---|
| 2,532,315 | 12/1950 | Johnson | 316/12 |
| 2,870,315 | 1/1959 | Lindsay | 316/5 |
| 3,728,004 | 4/1973 | Waymouth | 316/12 |

*Primary Examiner*—W. Tupman

*Attorney, Agent, or Firm*—Glenn H. Bruestle; George E. Haas

[57] ABSTRACT

By heating as many of the electrodes as possible in a vidicon tube during and after the cathode activation, the potentiality for gas contamination of the electrodes is greatly reduced and the life of the tube is extended.

5 Claims, 1 Drawing Figure

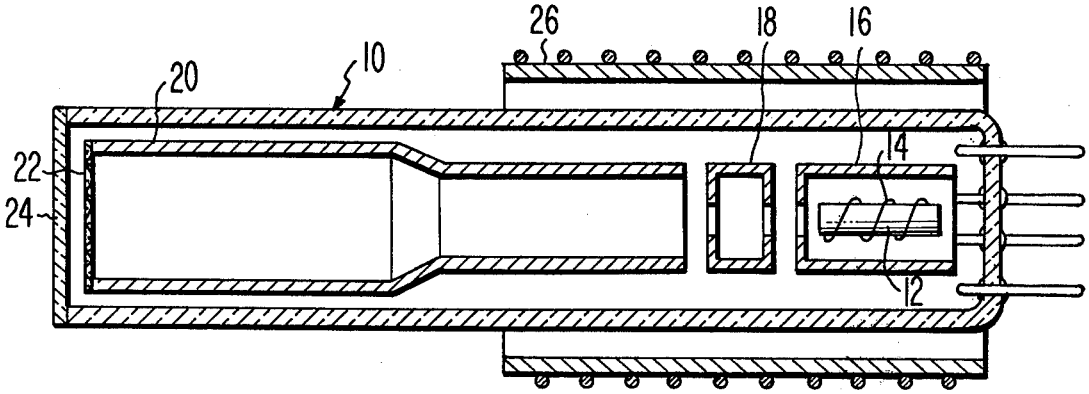
26
18
16
10
20
14
22
24
12

METHOD FOR EXTENDING CATHODE LIFE IN VIDICON TUBES

BACKGROUND OF THE INVENTION

This invention relates to methods for processing electron tubes and more specifically to vidicon tubes.

The operating life of a vidicon tube is largely determined by the life of the thermionic cathode. The cathode often fails because of poisoning by contaminants from the tube environment before the end of its normal lifetime. Some of the contaminants are released during the activation of the tube's cathode. The cathode initially has a coating of several carbonates, such as barium, calcium and strontium carbonates, in a binder. During the exhausting of the tube, the cathode is activated by first vaporizing the binder and then converting the carbonates to oxides by using heat from both the cathode filament and an external RF heater. During normal activation some of the binder material and other by-products of the cathode conversion are deposited on the surface of other electrodes within the tube. Later during normal operation of the tube, the contaminants on the electrode surfaces are released as gases when the electrodes are scanned with the electron beam. The cathode is then exposed to these gases resulting in the poisoning and shortening of the cathode's life.

SUMMARY OF THE INVENTION

The cathode life in vidicon tubes may be extended by heating at least some of the electrodes in the vidicon during and after the cathode activation. The heating of the electrodes prevents gaseous contaminants from the cathode activation from being deposited upon the electrode surfaces.

BRIEF DESCRIPTION OF THE DRAWING

The drawing is a sectional view of a vidicon tube during a step in the present process.

DETAILED DESCRIPTION OF THE INVENTION

As shown in the drawing, at one end of a vidicon tube 10 is a cathode 12 with a heater filament 14. The vidicon tube 10 also has a control grid electrode 16, an accelerating grid electrode 18, a focusing grid electrode 20 and a mesh 22. A vidicon target 24 is positioned at the opposite end of the tube 10 from the cathode 12.

After the tube has been assembled and evacuated, the control grid and accelerating grid electrodes 16 and 18 are thoroughly heated and the focusing grid electrode 20 is partially heated to remove any absorbed gases. The heating is accomplished by placing a heater 26, such as a radio frequency heating coil, around the portion of the tube containing the control and accelerating electrodes 16 and 18 and the end of the focusing electrode 20 nearest the cathode 12. The cathode 12 then is activated by heating it up using the heater filament 14 and the heater 26 so that the binder material in the cathode coating is vaporized and the carbonates in the coating are converted to oxides. The grid electrodes 16, 18 and 20 are heated to a temperature which will vaporize any contaminants from the cathode activation which may have been absorbed or deposited on their surfaces. A temperature of about 700° C, for example, is sufficient to vaporize the contaminants. During the heating of the electrodes, the tube is connected to an evacuation means to remove the vaporized contaminants from the tube. The heating is continued after the cathode conversion has been completed to insure the complete vaporization of contaminants from the electrode surfaces.

In some vidicon tubes, the target 24 is attached to the tube 10 using sealing material which has a relatively low melting point, such as indium. In this case, the heater 26 cannot be employed to heat all of the electrodes in the tube satisfactorily, since the heat from the electrodes close to the target might cause the seal to melt. When seals having low melting points are used, additional steps may be taken to prevent the contaminants from being deposited upon the electrodes near the target 24. After activation of the cathode, an electron beam is generated by the cathode which scans the focusing electrode 20 and the mesh 22. The scanning is sufficient to locally heat the focusing electrode 20 and the mesh 22 to a temperature which will vaporize any deposited contaminants. The scanning may be carried out for one hour by applying 1200 volts to the mesh, 900 volts to the focusing electrode, 300 volts to the accelerating electrode and zero potential to the control grid. The filament should heat the cathode above normal operating temperature during the scanning to prevent poisoning of the cathode. Although it is not necessary, the heater 26 may be employed to heat the control and accelerating electrodes 16 and 18 during the electron beam scanning to prevent any contaminants released by the scanning from being redeposited upon the control and accelerating electrodes.

The present method prevents the contaminants from the cathode activation from being deposited on the electrodes of the tube where the contaminants may be vaporized during normal tube operation. By heating the control electrode 16, the accelerating electrode 18 and the focusing electrode 20 during activation of the cathode, the contaminating vapors are either exhausted with the other gases in the tube or deposited elsewhere in the tube envelope. The scanning of the surfaces of the focusing electrode 20 and mesh 22 vaporizes any of the contaminants that may have been deposited upon these surfaces. The vaporized contaminants from the scanning are either absorbed by a getter or deposited on surfaces of the tube where they will not vaporize and poison the cathode during operation of the device. This novel method has reduced the possibility that contaminants remaining in the tube after its exhaustion, will be vaporized during the normal operation of the tube and poison the cathode.

We claim:

1. A method for processing a vidicon tube having a low melting point target assembly to reduce cathode contamination, said method comprising:

evacuating the tube;

activating the cathode;

heating some of the electrodes within the tube during and after cathode activation to a temperature which will vaporize any contaminants from the cathode activation while maintaining the target assembly below its melting point; and pumping any vapors emitted by the evaporating and heating steps out of the tube.

2. The method as in claim 1 further including:

scanning the electrodes near the target with an electron beam to locally heat the electrodes and vaporize any deposited contaminants.

3. The method as in claim 2 including heating the cathode above the normal operating temperatures during the scanning step.

4. The method as in claim 2 including heating during the scanning step any electrodes which are not scanned.

5. The method as in claim 1 wherein the electrodes are heated to about 700° C.

* * * * *